US006000060A

United States Patent [19]

Borucki-Mastej

[11] Patent Number: 6,000,060

[45] Date of Patent: Dec. 14, 1999

[54] WATERPROOF SCOURING GLOVE

[76] Inventor: Kathleen Borucki-Mastej, 8710 W. 40th St., Lyons, Ill. 60534

[21] Appl. No.: 09/161,839

[22] Filed: Sep. 28, 1998

[51] Int. Cl.[6] ..... A41D 19/00

[52] U.S. Cl. ..... 2/167; 2/161.6; 15/227; 15/229.11

[58] Field of Search ..... 2/158, 159, 160, 2/161.3, 161.6, 167; 15/227, 229.1

[56] References Cited

U.S. PATENT DOCUMENTS 645,406 3/1900 Potter .
1,179,871 4/1916 St. John .
3,151,333 10/1964 Scholz ..... 2/161
4,621,388 11/1986 Ortolivo ..... 15/227
5,419,014 5/1995 Piantedosi ..... 15/227

*Primary Examiner*—Diana Oleksa
*Assistant Examiner*—Kate Moran
*Attorney, Agent, or Firm*—Goldstein & Canino

[57] ABSTRACT

A waterproof scouring glove comprising a glove-like sheath having an abrasive material disposed along the entire outer surface so that a user may scour a kitchen implement or similar item without the need to grasp a separate scouring pad or sponge.

1 Claim, 2 Drawing Sheets

WATERPROOF SCOURING GLOVE

FIELD OF THE INVENTION

The invention relates to a waterproof scouring glove. More particularly, the invention relates to waterproof gloves having abrasive surfaces for scouring, cleaning and/or buffing purposes.

BACKGROUND OF THE INVENTION

Heretofore, waterproofed washing and scrubbing mitts have been used only to protect the user's hands from harsh detergents and other chemicals which are utilized in most cleaning operations. Typically, the user dons the wash mitts and then grasps a steel wool-like scouring pad to clean an intended item such as a kitchen implement. This task can often prove cumbersome and daunting in that the scouring pad is difficult to retain within the user's hand due to the slippery, smooth quality of the rubber wash mitt.

In certain instances, abrasive cleaning surfaces have been attached to waterproof cleaning gloves and mitts. Typically though, in these instances, the abrasive natured substances are secured only to the mitt's palm and finger-tip region. In essence, the majority of the surface area of these gloves is unusable for cleaning purposes, and the wearer is restricted to utilizing only the small palm or fingertip region for cleaning purposes.

While these prior art units may be suitable for the particular purpose employed, or for general use, they would not be as suitable for the purposes of the present invention as disclosed hereafter.

SUMMARY OF THE INVENTION

The present invention relates to a waterproof scouring glove. More particularly, the invention relates to waterproof gloves having abrasive surfaces for scouring, cleaning and/or buffing purposes.

In accordance with the invention, there is provided a waterproof scouring glove which allows a user to efficiently clean items such as kitchen implements, hardware, automobiles and the like.

Further in accordance with the invention, there is provided a waterproof scouring glove which dispenses with the need for the user to grasp an independent, detached scouring pad in order to clean a particular item.

Further in accordance with the invention, there is provided a waterproof scouring glove which possesses abrasive materials bonded to the surface thereof while retaining the flexibility needed to efficiently scour a desired item.

Also in accordance with the invention there is provided a waterproof scouring glove which enables an arthritic or partially handicapped person to more easily perform scrubbing and scouring tasks.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
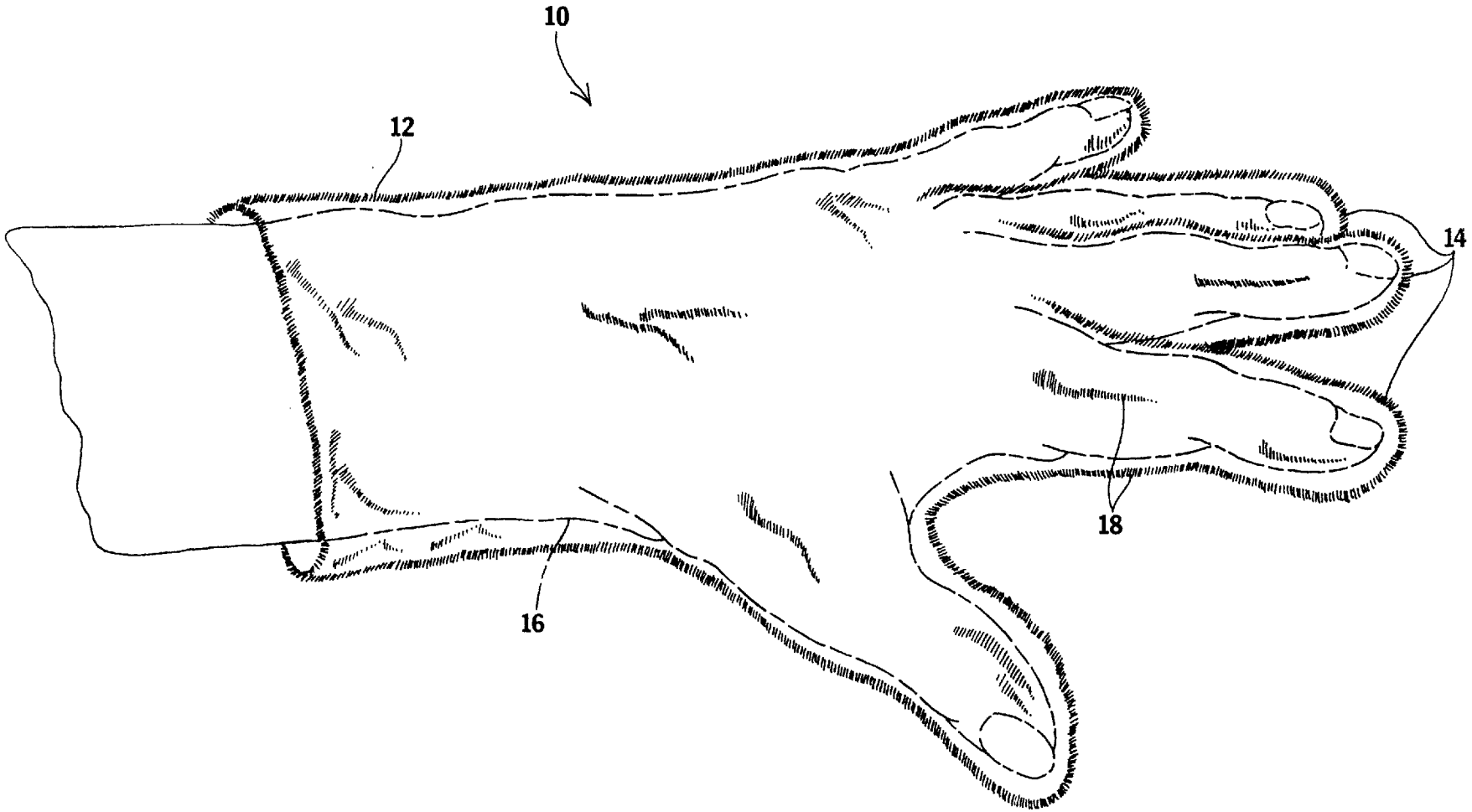
FIG. 1 is a diagrammatic perspective view of a waterproof scouring glove of the instant invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the waterproof scouring glove. The words "proximal end" and "distal end" refer, respectively, to ends of an object nearer to and further from the operator of the object when the object is used in a normal fashion or as is described in the specification.

Figure 2:
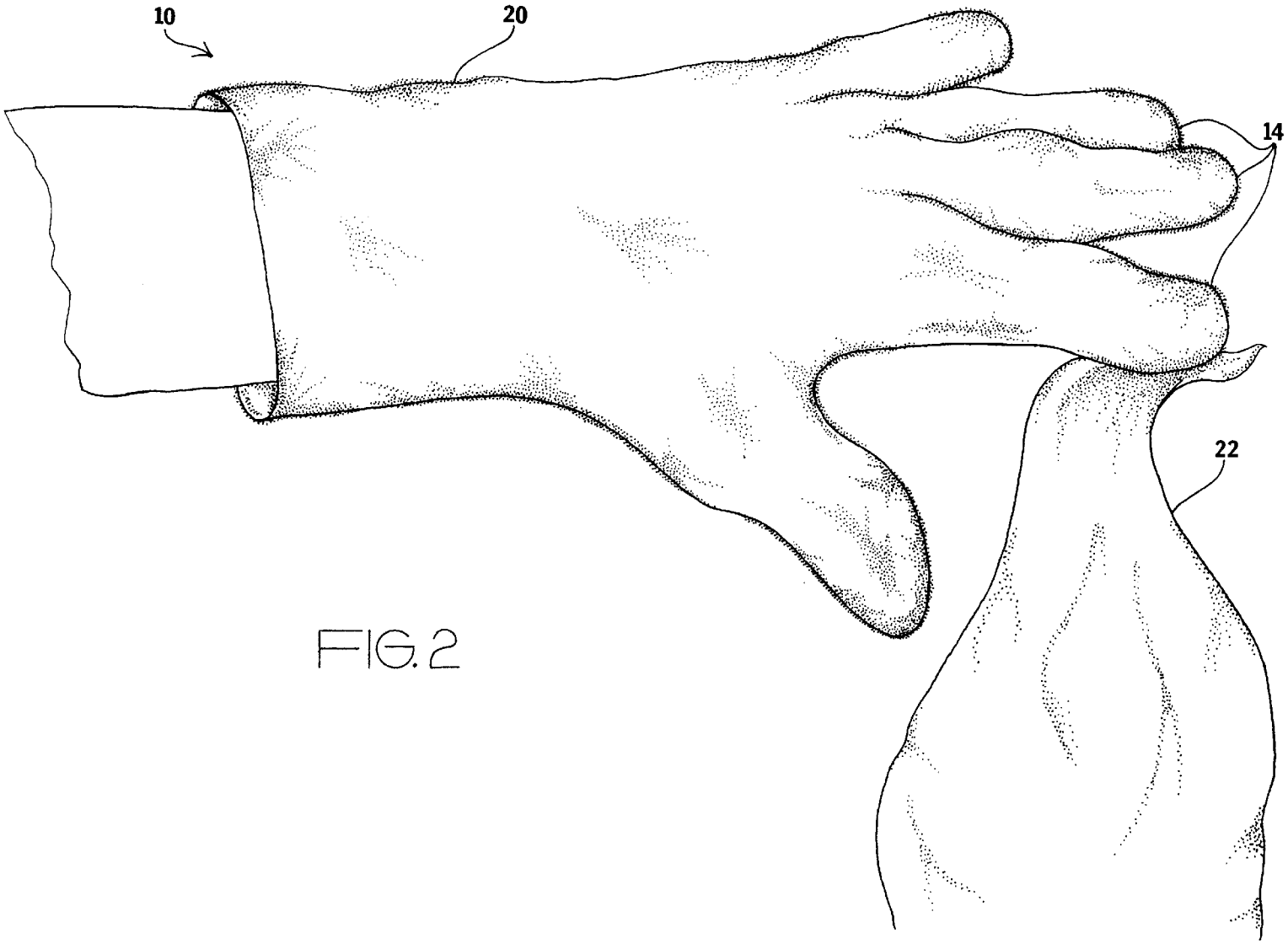
FIG. 2 is a diagrammatic perspective view of an alternate embodiment of the waterproof scouring glove of the instant invention.

FIG. 1 illustrates a diagrammatic perspective of a waterproof scouring glove 10 of the instant invention. As seen, the waterproof scouring glove 10 comprises a sheath 12 having a plurality of cavities 14 for accepting human fingers when the sheath 12 is caused to enclose a human hand 16. The sheath 12 which comprises the glove 10 of the instant invention is preferably constructed of latex or any other synthetic (or organic) material which is resilient and possesses water-repellent properties. It is contemplated that the material which is employed in the construction of the sheath 12 be flexible so that an individual who is utilizing said device may comfortably manipulate the glove and fingers in order to conveniently clean intricate regions. FIG. 1 further illustrates that the entire outer surface area of the sheath 12, including the cavities 14 which form the fingers thereof, is coated with an abrasive material 18 to enable a user to efficiently scour an intended subject such as a kitchen implement, hardware item or the like FIG. 2 illustrates a second embodiment of the waterproof scouring glove 10 of the instant invention. This second embodiment resembles the first in all aspects except that the sheath 12 and cavities 14 which form the glove fingers thereof are coated with a hook-and-loop fastener material 20 rather than an abrasive material 18. Accordingly, various attachments 22 which have mateably configured hook-and-loop fastener material secured thereto (such as cloths or sponges or varying abrasiveness) can be detachably secured to the sheath 12 and employed to polish or scour according to the user's particular needs. For example, if the user wishes to polish an automobile, a soft, non-abrasive cloth can be secured to the sheath and employed by the user. If the user wishes to scour a greasy kitchen pot, a more abrasive attachment 22 can be secured to the sheath 12.

What is claimed is:

1. A waterproof scouring glove system, comprising:

a) a sheath for encapsulating a human hand, said sheath having a plurality of cavities for accepting human fingers, said sheath comprised of a resilient, flexible yet waterproof material;

b) hook-and-loop fastener material disposed upon the entire surface of the sheath and cavities thereof; and c) attachment cloths having hook-and-loop fasteners disposed thereupon which are mateable to the hook-and-loop fastener located upon the surface of the sheath and cavities such that said attachment cloths may be selectively detachably secured to said sheath.

* * * * *